United States Patent [19]

Cremona

[11] 4,102,372

[45] Jul. 25, 1978

[54] DEVICE TO FIX THE WOOD-STOCK WITH HOOKS OF DIFFERENT LENGTH AND FOR REMOTE CONTROLLED EXTENSION OR RETRACTION OF SAID HOOKS FROM OR IN THE VERTICAL OR ALMOST VERTICAL SUPPORTING TABLE OF A VENEER SLICING MACHINE

[76] Inventor: Angelo Cremona, V. le Lombardia, 275, Monza, Italy, 20052

[21] Appl. No.: 737,276

[22] Filed: Nov. 1, 1976

[30] Foreign Application Priority Data

May 21, 1976 [IT] Italy ..... 23519 A/76

[51] Int. Cl.[2] ..... B27C 1/00

[52] U.S. Cl. ..... 144/178; 144/214; 269/244; 269/247

[58] Field of Search ..... 248/362, 363; 269/21, 269/244, 247, 257, 258; 144/177, 178, 179, 214

[56] References Cited

U.S. PATENT DOCUMENTS

| | | | |
|---|---|---|---|
| 2,676,627 | 4/1954 | McFall | 144/178 |
| 3,680,612 | 8/1972 | Hale | 144/178 |
| 3,905,408 | 9/1975 | Hale | 144/178 |

*Primary Examiner*—Gil Weidenfeld
*Assistant Examiner*—W. D. Bray
*Attorney, Agent, or Firm*—McGlew and Tuttle

[57] ABSTRACT

A generally vertical veneer slicing device having a plurality of holding hooks for supporting a wood-stock on a generally vertical supporting table. Each of the respective holding hooks include a pair of complementary adjustable jaw members for gripping the wood-stock therebetween wherein the complementary pairs of jaw members vary in length. The arrangement is such that the holding hooks are rendered selectively operative so that progressively smaller hooks are used for supporting the wood-stock as the wood-stock is reduced in size during a cutting operation with the larger length jaw members being shifted to an inoperative out-of-the way position.

6 Claims, 3 Drawing Figures

DEVICE TO FIX THE WOOD-STOCK WITH HOOKS OF DIFFERENT LENGTH AND FOR REMOTE CONTROLLED EXTENSION OR RETRACTION OF SAID HOOKS FROM OR IN THE VERTICAL OR ALMOST VERTICAL SUPPORTING TABLE OF A VENEER SLICING MACHINE

In vertical or almost vertical veneer slicing machines known in the art, the wood stock, according to its dimensions which keep decreasing in thickness, requires in order to fix it to the table supporting it, hooks of constantly decreasing length, so as to maintain free, besides the hooks also a portion of the wood stock to be reduced in sheets.

It is therefore necessary for the operator to stop the knife and pressure bar holder during its feeding stroke, every time the fixing hooks have to be replaced by others of smaller length, since in the negative the blade would strike the hooks and could be damaged.

The necessity is therefore obvious that replacement of the hooks of a certain length with those of another length on the wood-supporting table, be performed in an easy manner and without dead times and above all that is is performed automatically and without any manual operation, so as to achieve a certain amount of safety for the operator who may stand away from moving parts of the veneer slicer machine, and so as to ensure the continuity of the operating cycle.

For this purpose the device according to the present invention has been devised and it presents the following constructional features:

(1) The new device illustrating the invention comprises provides several pairs of hooks of different length designed at first to be applied all simultaneously on the wood stock and to come away from it - starting with the longer ones up to the shorter ones - as the wood stock is being cut;

(2) The new device illustrating the invention comprises several compartments inside the wood-supporting table, located at its ends, in which may be housed the pairs of hooks when they are not in use any more;

(3The new device illustrating the invention comprises remote control means for extension or retraction of the aforesaid hooks from or in the table, capable of vertically moving the hooks towards the nearer end of the table and then rotating them by 90° so as to place them in the aforesaid compartments below the wood stock supporting plane;

(4) The new device illustrating the invention further includes a means for remote control of the hooks, an equal number of reduction motors the shafts of which are connected to the screws on which the hooks are displaceable, and which may be actuated by the operator by means of a push-button panel located outside the wood-shearing machine.

Such push-button panel does not form part of the invention, as considered in se, and it will not be described in detail because such operator controlled push-button panels are well known in the art of remote controls and those skilled in said art will readily conceive how to provide such panel and selectively connect the individual push-buttons thereof to the various electrically operated actuators, namely the screw-driving motors so that the operator can selectively activate and disactivate the same.

The accompanying drawings, given by way of example only and without limitation, show a preferred embodiment of the device according to the invention.

Figure 1:
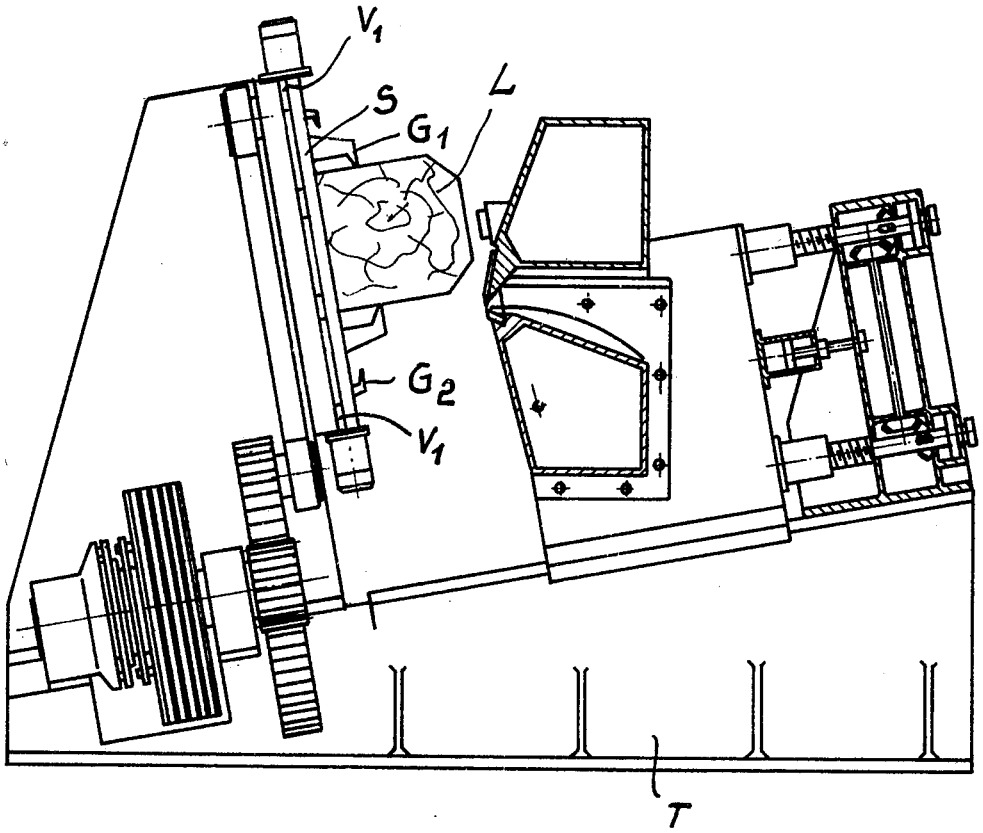
FIG. 1 is a side view of the veneer slicing machine provided with the device according to the invention.

As may be seen from the drawings (FIG. 1), veneer slicer T comprises a supporting table S for the wood stock L, almost vertical, on which are provided holding hooks, $G_1$, $G_2$ each of which includes a pair of complementary jaw members having a longer and shorter length respectively.

Figure 2:
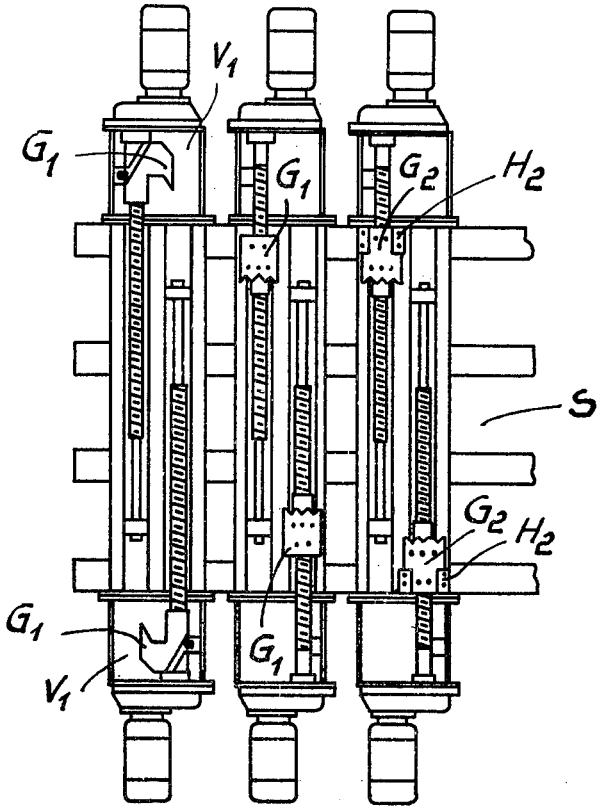
FIG. 2 is a front view, on an enlarged scale, of a portion of a vertical or almost vertical wood supporting table, provided with three pairs of hooks of different lengths and their relevant displacemente means.

When the wood stock L has been cut into sheets of a certain thickness, the longer jaw members of hooks $G_1$ are not needed any more and are moved away from the wood stock and concealed in compartments $V_1$. FIG. 2 shows in detail a pair of shorter jaw members of hooks $G_2$ having a stroke defined by mechanical stops $H_2$ and which are not rotatable since their concealment is not necessary, as well as two pairs of longer jaw members of hooks $G_1$ one of which is concealed in the respective compartment $V_1$ while the other is still projecting on the supporting table S.

Figure 3:
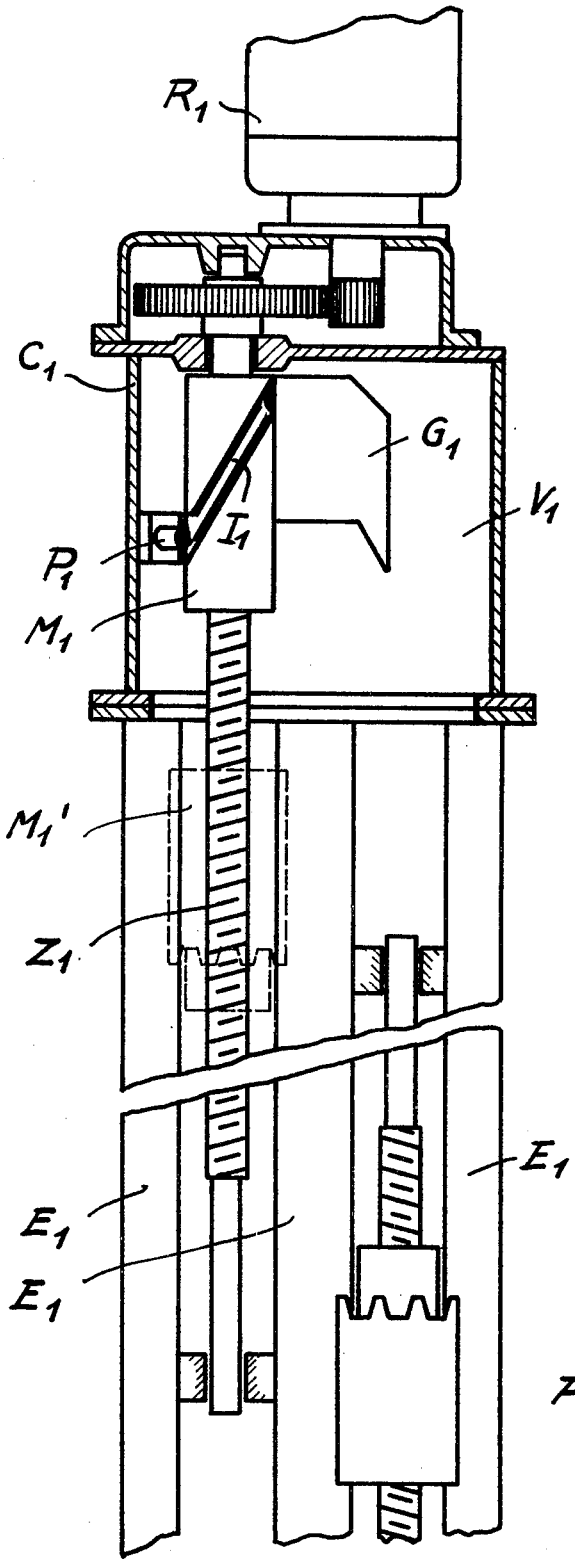
FIG. 3 is another view similar to FIG. 2 but on a more enlarged scale, showing a single pair of hooks and the displacement means therefor.

More particularly, each hook $G_1$ is guidedly slidable along nearly vertical guides or slides $E_1$ (FIG. 3) so that it can be vertically reciprocated upon rotation of a respective screw bar $Z_1$ while the slide prevents the hook from rotating and causes the same hook to maintain its operative outwardly projecting arrangement shown in FIG. 1. FIG. 3 illustrates in detail the upper end portion of a screw $Z_1$ cooperating with one downwardly pointing hook, the arrangement and the operation of any upwardly pointing hook (such as those shown in the lower part of FIG. 2) being quite similar, except that such latter hooks are arranged upside down relatively to the former ones. The length of said slides $E_1$ and screws $Z_1$ is evidently adequate for providing the necessary stroke for securing wood stock of variable dimensions.

Referring again to FIG. 3, one end portion of the screw $Z_1$ is rotatably but not axially supported or carried in and through the upper wall portion of a box-like structure $C_1$ which therefore carries the screw $Z_1$ and the hook $G_1$ secured thereto. Such structure will therefore be termed carrying box as this specification proceeds and in the appended claims. Such box is downwardly open and the hook $G_1$ together with its related nut screw $M_1$ can completely retract thereinto at the upmost end of the stroke (of the lowermost end, for the lower and upwardly pointing hooks). This box $C_1$ is also open at its face turned toward the block (not shown) and therefore such box forms a compartment $V_1$ wherein the hook $G_1$ can be concealed upon having reached its uppermost position (see also FIG. 2, the hook at left hand).

This concealment occurs when the hook moves along the last portion of its stroke, well far from the wood stock which had previously been engaged, upon a rotation of 90° about the axis of the screw $Z_1$ (compare the left hand and the center hook in FIG. 2) upon the engagement of a stake or pine $P_1$, which is stationary and secured to and within the box $C_1$ with a helical groove or recess $I_1$ formed in the said nut screw $M_1$.

From a consideration of the accompany drawing it will be clearly evident that the device of the invention comprises means which:

1. Provide the most sure and positive action of the wood stock fixing hook, because each hook is individually moved by means of a screw-and-nut mechanism, upon rotationally driving the screw;

2. Cause the hook to fully retract from the space where such hook might interfer with the blade of veneer slicing machine;

3. Such retraction is promoted simply by prosecuting the stroke of the hook beyond the position at which the hook might had engaged a wood stock, while the hook structure (comprising its nut screw) remains fully engaged about the screw;

4. The movement leading to the concealment of the hook (rotation about the axis of the screw) does not impair the said nut-and-screw engagement and therefore does not impair the structure by means of which the hook exerts on the wood block the strong pressure which is necessary for making fast and fix wood block to be processed.

It is obvious that the hook lengths which are two in the aforesaid example, may be three or more and the pairs of hooks to be used which are two in FIG. 1, and three in FIG. 2, may be more than two or three, all having the same length or not.

FIG. 3 clearly shows that each hook, supposing $G_1$, is provided integral with nut screw $M_1$ which is provided internally with a helical recess $I_1$ within which slides a stake $P_1$ which is integral with carrying box $C_1$. The latter is open at the front and defines internally, compartment $V_1$ in which hook $G_1$ is housed when it is not in use.

Said carrying box $C_1$ also contains the reduction unit $R_1$ connected to screw $Z_1$. FIG. 3 also shows guides $E_1$ which force hook $G_1$ and its respective nut screw $M_1$ to run without rotating any more after it has left compartment $V_1$, that is, when stake $P_1$ has come out of the helical recess $I_1$. Nut screw $M_1$ is shown with a dotted line at $M'_1$ in the position it assumes when it is rotated by 90° with hook $G_1$ projecting from the table.

What I claim is:

1. A generally vertical veneer slicing apparatus comprising a generally vertical supporting table, a plurality of pairs of opposed holding hooks supported on said table, each of said pairs of hooks forming complementary opposed jaw members, means for effecting vertical adjustment of the respective complementary pairs of holding hooks over a predetermined distance for supporting therebetween wood stock of varying sizes, rotation means for rotating the respective jaw members between an operative projected position relative to said table and an inoperative out of the way position, each of said jaw members having a distinct length at which they project outwardly from said table whereby the respective jaw members are rendered selectively operative to supporting a wood stock therebetween so that the progressively shorter length jaw members support the wood stock as it is being progressively cut away, said adjusting means including a screw operatively connected to each of said complementary pair of jaw members, and a drive means operatively connected to said screw to effect the drive thereof, said rotating means including a nut connected to the respective jaw member, said nut being rotatable on said screw, a helical groove formed in said nut, a pin adapted to be received in said groove whereby said pin effects the rotation of said nut and connected jaw member between operative and inoperative position.

2. The apparatus as defined in claim 1 and including means defining a compartment for accommodating said jaw member in the inoperative position.

3. The apparatus as defined in claim 1, and including stop means disposed in the path of movement of the shortest of said complementary pairs of jaw members for limiting the adjustment of the shortest of said complementary pairs of jaw members.

4. A generally vertical veneer slicing apparatus comprising a generally vertical supporting table, a plurality of pairs of opposed holding hooks, means for supporting a wood stock on said table, each of said holding hook pairs forming complementary opposed jaw members for supporting therebetween the wood stock to be cut, each of said pair of jaw members being of a progressively decreasing length, a screw operatively associated with each jaw member of said pairs of complementary jaws, a nut connected to each said jaw member, said nut being rotatably journalled on an associated screw, each of said nuts having a helical groove formed thereon, a pin adapted to be received in said groove, a drive means operatively connected to said screw for effecting the rotation thereof, said drive means including a drive motor which can be remotely controlled for effecting the rotation of its associated screw whereby said jaw member associated with each respective screw can be rotated between an operative and inoperative position, and in the operative position being vertically adjusted to grip therebetween the wood stock.

5. The apparatus as defined in claim 4 and including guide means for guiding said complementary pair of jaw member through their respective vertical adjustment.

6. The apparatus as defined in claim 5, and including stop means disposed in the path of movement of the shortest of said complementary pairs of jaw members for limiting the vertical adjustment of the shortest of said complementary pairs of jaw members.

* * * * *